US006501447B1

(12) United States Patent
Kang et al.

(10) Patent No.: US 6,501,447 B1
(45) Date of Patent: Dec. 31, 2002

(54) PLASMA DISPLAY PANEL EMPLOYING RADIO FREQUENCY AND METHOD OF DRIVING THE SAME

(75) Inventors: Jung Won Kang, Seoul (KR); Jun Weon Song, Seoul (KR); Oe Dong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/526,447

(22) Filed: Mar. 16, 2000

(30) Foreign Application Priority Data

Mar. 16, 1999 (KR) ..... 99-8843
Dec. 13, 1999 (KR) ..... 99-57032

(51) Int. Cl.[7] ..... G09G 3/28
(52) U.S. Cl. ..... 345/67; 345/68
(58) Field of Search ..... 345/60, 55, 67; 315/169.1, 169.4; 445/24

(56) References Cited

U.S. PATENT DOCUMENTS 5,420,602 A * 5/1995 Kanazawa ..... 345/67
5,667,705 A * 9/1997 Miyazaki et al. ..... 345/60
5,790,087 A * 8/1998 Shigeta et al. ..... 345/67
5,828,353 A * 10/1998 Kishi et al. ..... 345/55
5,982,344 A * 11/1999 Tokunaga ..... 345/67
5,990,630 A * 11/1999 Nakamura ..... 345/60
6,054,970 A * 4/2000 Hirakawa et al. ..... 345/60
6,181,305 B1 * 1/2001 Nguyen et al. ..... 345/60
6,340,866 B1 * 1/2002 Yoo ..... 315/169.3

* cited by examiner

*Primary Examiner*—Steven Saras
(74) *Attorney, Agent, or Firm*—Fleshner & Kim, LLP

(57) ABSTRACT

A plasma display panel having a structure that is capable of reducing a discharge area to decrease a discharge power. In the panel, first and second electrodes for generating a radio frequency discharge are arranged to be opposite and perpendicular to each other. The two electrodes generating the radio frequency discharge are perpendicularly arranged to limit the luminous area into the perpendicular area, thereby reducing a discharge power and improving the luminescence efficiency.

6 Claims, 8 Drawing Sheets

PLASMA DISPLAY PANEL EMPLOYING RADIO FREQUENCY AND METHOD OF DRIVING THE SAME

BACKGROUND OF THE INVENTION

1. Field of the Invention

This invention relates to a plasma display device employing a radio frequency, and more particularly to a plasma display panel that is capable of reducing a discharge power of a plasma display panel using a radio frequency and a method of driving the same.

2. Description of the Related Art

Recently, a plasma display panel (PDP) feasible to the fabrication of large-scale panel has been available for a flat panel display device. The PDP includes discharge cells corresponding to color pixels of matrix type and controls a discharge interval of each discharge cell to display a picture. More specifically, after the PDP selected discharge cells to be displayed by an address discharge, it allows a discharge to be maintained in a desired discharge interval at the selected discharge cells. Thus, in the discharge cells, a vacuum ultraviolet ray generated during the sustaining discharge radiates a fluorescent material to emit a visible light. In this case, the PDP controls a discharge sustaining interval, that is, a sustaining discharge frequency of the discharge cells to implement a gray scale required for an image display. As a result, the sustaining discharge frequency becomes an important factor for determining the brightness and a discharge efficiency of the PDP. For the purpose of performing such a sustaining discharge, a sustaining pulse having a frequency of 200 to 300kHz and a width of about 10 to 20$\mu$s has been used in the prior art. However, the sustaining discharge is generated only once at a extremely short instant per the sustaining pulse by responding to the sustaining pulse; while it is wasted for a step of forming a wall charge and a step of preparing the next sustaining discharge at the remaining major time. For this reason, the conventional three-electrode, face-discharge, and AC PDP has a problem in that, since a real discharge interval is very short in comparison to the entire discharge interval, the brightness and the discharge efficiency become low.

In order to solve such a problem of low brightness and low discharge efficiency, we has suggested a method of utilizing a radio frequency discharge employing a radio frequency signal of hundreds of MHz as a display discharge. In the case of the radio frequency discharge, electrons perform an oscillating motion by the radio frequency signal to sustain the display discharge in a time interval when the radio frequency signal is being applied. More specifically, when a radio frequency signal with a continuously alternating polarity is applied to any one of the two opposite electrodes, electrons within the discharge space are moved toward one electrode or the other electrode depending on the polarity of the voltage signal. If the polarity of a radio. frequency voltage signal having been applied to the electrode before the electrons arrive at the electrode is changed when electrons are moved into any one electrode, then the electrons has a gradually decelerated movement speed in such a manner to allow their movement direction to be changed toward the opposite electrode. The polarity of the radio frequency voltage signal having been applied to the electrode before the electrons within the discharge space arrive at the electrode is changed as described, so that the electrons make an oscillating motion between the two electrodes. Accordingly, when the radio frequency voltage signal is being applied, the ionization, the excitation and the transition of gas particles are continuously generated without extinction of electrons. The display discharge is sustained during most discharge time, so that the brightness and the discharge efficiency of the PDP can be improved. Such a radio frequency discharge has the same physical characteristic as a positive column in a glow discharge structure.

FIG. 1 and FIG. 2 are a perspective view and a sectional view showing the structure of the above-mentioned radio frequency PDP employing a radio frequency discharge, respectively. In FIG. 1 and FIG. 2, the PDP includes radio frequency electrodes 12 provided on an upper substrate 10, data electrodes 18 and scanning electrodes 22 provided on a lower substrate 16 in such a manner to be perpendicular to each other, and barrier ribs 28 provided between the upper substrate 10 and the lower substrate 16. The radio frequency electrodes 12 apply a radio frequency signal. A first dielectric layer 14 is formed on the upper substrate 10 provided with the radio frequency electrodes 12. The data electrodes 18 apply a data pulse for selecting cells to be displayed. The scanning electrodes 22 are provided in opposition to the radio frequency electrodes 12 in such a manner to be used as opposite electrodes of the radio frequency electrodes 12. Between the data electrodes 18 and the scanning electrodes 22 is provided a second dielectric layer 20 for the charge accumulation and the isolation. On the second dielectric layer 20 provided with the scanning electrodes 22, a third dielectric layer 24 for the charge accumulation and a protective film 26 are sequentially disposed. The barrier ribs 28 shut off an optical interference between the cells. In this case, since a distance between the radio frequency electrode 12 and the scanning electrode 22 is sufficiently assured for the sake of a smooth radio frequency discharge, the barrier ribs 24 are provided at a higher level than those in the existent three-electrode, AC, and face-discharge PDP. Otherwise, the barrier ribs 28 may be formed into a lattice structure closed on every side for each discharge cell so as to isolate the discharge space. This is because it is difficult to isolate a plasma for each cell unlike the existent face discharge due to the opposite discharge generated between the radio frequency electrodes 12 and the scanning electrodes 22. A fluorescent material 30 is coated on the surface of the barrier rib 28 to emit a visible light with an inherent color by a vacuum ultraviolet ray generated during the radio frequency discharge. The discharge space defined by the upper substrate 10, the lower substrate 16 and the barrier ribs 28 is filled with a discharge gas.

In the PDP having the configuration as described above, as shown in FIG. 3, discharge cells 32 are provided at each intersection among the radio frequency electrodes 12, the scanning electrodes 22 and the data electrodes 18. The radio frequency electrodes 12 are arranged in parallel to the scanning electrodes 22, and the data electrodes 18 are arranged in a direction crossing the radio frequency electrodes 12 and the scanning electrodes 22. At a certain discharge cell 32, an address discharge is generated between the data electrode 18 and the scanning electrode 22, and a radio frequency discharge is generated by a radio frequency signal applied to the radio frequency electrode 12.

Specifically, the conventional radio frequency PDP is driven with a drive waveform as shown in FIG. 4. Generally, the PDP implements an image of one frame by a combination of a number of sub-field. Each sub-field is driven with being divided into an address interval and a discharge sustaining interval. In the address interval, a scanning pulse SP is line-sequentially applied to the scanning electrode 22. At the same time, the data electrode 18 is synchronized with the scanning pulse SP to apply a data pulse DP for each scanning line in accordance with a video data. Accordingly, an address discharge is generated by a voltage difference between the data electrode 18 and the scanning electrode 22 at the discharge cells supplied with the data pulse DP. Most electric charge particles produced by the address discharge are accumulated into a shape of wall charge.

After the lapse of such an address interval, a radio frequency signal RF is applied to the radio frequency electrodes 12 in the discharge sustaining interval to continuously generate a radio frequency discharge at the discharge cells at which the address discharge has been generated. This radio frequency discharge is initiated by a triggering pulse TP applied alternately to the data electrodes 18 and the scanning electrodes 22. This is because, since most charged particles produced by the address discharge are accumulated into a wall charge, it is difficult to induce the radio frequency discharge making use of an electron oscillation only by the radio frequency signal RF applied to the radio frequency electrodes 12. Ton other words, the triggering pulse TP is applied to the data electrodes 18 and the scanning electrodes 22 to generate a triggering discharge at the discharge cells at which a wall charge has been formed by the address discharge. More charged particles are activated by the triggering discharge to easily initiate the radio frequency discharge by the radio frequency signal. Also, the triggering discharge uniforms a wall charge amount having a non-uniform distribution at each discharge cell due to a discharge time difference in the address discharge to generate a uniform radio frequency discharge. Electrons having a high relative mobility in the charged particles activated by such a triggering discharge make an oscillation motion within the discharge space by the radio frequency signal. The electrons making an oscillation motion excite a discharge gas to generate a vacuum ultraviolet ray. The vacuum ultraviolet ray radiates the fluorescent material 30 to generate a visible light.

As described above, in the conventional PDP, the radio frequency discharge is generated between the radio frequency electrodes 12 and the scanning electrode arranged in parallel to each other. In this case, a luminous area (A) proportional to an area of the opposite electrode is diffused and widen into the barrier ribs 28 positioned at each side of the discharge cells 32. If the luminous area (A) is widen, however, a discharge power for the radio frequency discharge is more consumed in proportion to the luminous area (A). Also, when the luminous area (A) has been diffused into the barrier ribs 28, a spurious energy is wasted due to electrons absorbed into the barrier ribs 28. Since an energy loss caused by electrons absorbed into the barrier ribs 28 must be compensated in order to maintain the radio frequency discharge, however, a discharge power is more consumed. If a discharge power, that is, a discharge current is increased, then exciting atoms of a discharge gas generating a vacuum ultraviolet at the PDP have a high de-excitation probability due to their collision with electrons to deteriorate the generation efficiency of a vacuum ultraviolet and hence the luminescence efficiency of a fluorescent material. Furthermore, since electrons absorbed into the barrier ribs 28 become abundant from a large luminous area (A) when the conventional radio frequency PDP has a fine structure for the sake of implementing a high resolution to reduce the size of discharge cell, a discharge power must be more increased to that extent so as to obtain an equal brightness.

Moreover, in the conventional radio frequency PDP, since the triggering discharge is generated at the lower part provided with the data electrodes 18 and the scanning electrodes, most charged particles produced by the discharge are concentrated at the vicinity of the lower plate. In other words, the charged particles to be used for the radio frequency discharge are positioned at a relatively distant area from the radio frequency electrodes 12. Accordingly, a higher level of radio frequency signal is required to bring electrons in the charged particles at the lower part into the radio frequency electrodes 12 for the radio frequency discharge, a lot of power is consumed. Otherwise, since a mount of electrons making an oscillation motion has a limit when the radio frequency signal fails to have a level enough to draw the electrons into the radio frequency, the luminescence efficiency is deteriorated.

SUMMARY OF THE INVENTION

Accordingly, it is an object of the present invention to provide a radio frequency PDP that is capable of reducing a discharge power as well as improving the luminescence efficiency by reducing a luminous area during a radio frequency discharge.

A further object of the present invention is to provide a radio frequency PDP that is capable of easily implementing a high resolution picture by reducing a luminous area during a radio frequency discharge.

A still further object of the present invention is to provide a method of driving a radio frequency PDP that is capable of reducing a discharge power as well as improving the luminescence efficiency.

In order to achieve these and other objects of the invention, a radio frequency plasma display panel according to one aspect of the present invention includes first and second electrodes, being arranged to be opposed and perpendicular to each other, to generate the radio frequency discharge.

A method of driving a radio frequency plasma display panel according to another aspect of the present invention includes the steps of (A) applying a pulse to each of a scanning electrode and a data electrode crossed with each other to cause an alternating current discharge, thereby selecting cells to be displayed; (B) applying a radio frequency signal to a radio frequency electrode and applying a reference voltage of the radio frequency signal to any one of the scanning electrode and the data electrode, thereby generating a radio frequency discharge at the cells selected at said step (A); and (C) supplying an alternating current pulse to the radio frequency electrode and the electrode to which the reference voltage is applied at a initiation time of the radio frequency discharge to generate a triggering discharge for initiating the radio frequency discharge.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
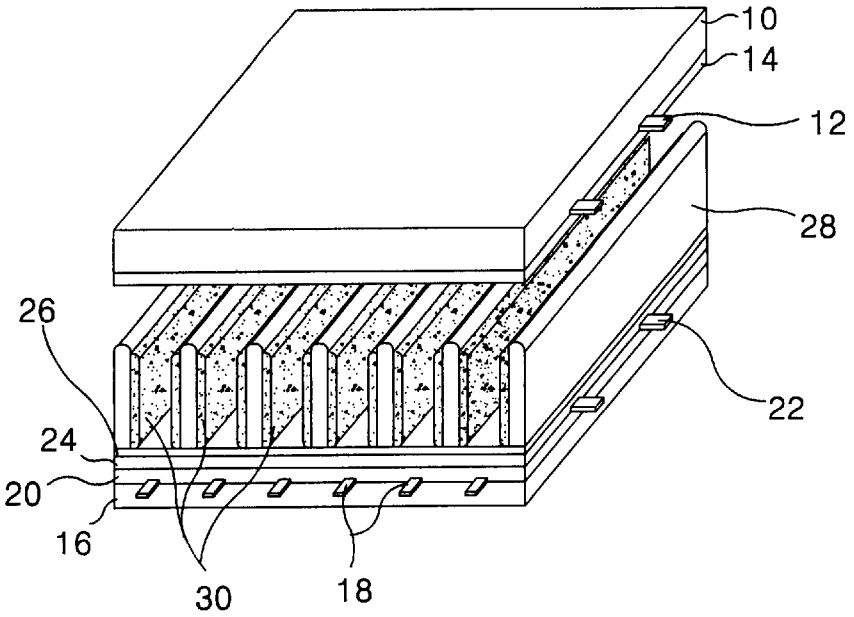
FIG. 1 RELATED ART
FIG. 1 is a perspective view showing the structure of the conventional radio frequency PDP.
Figure 2:
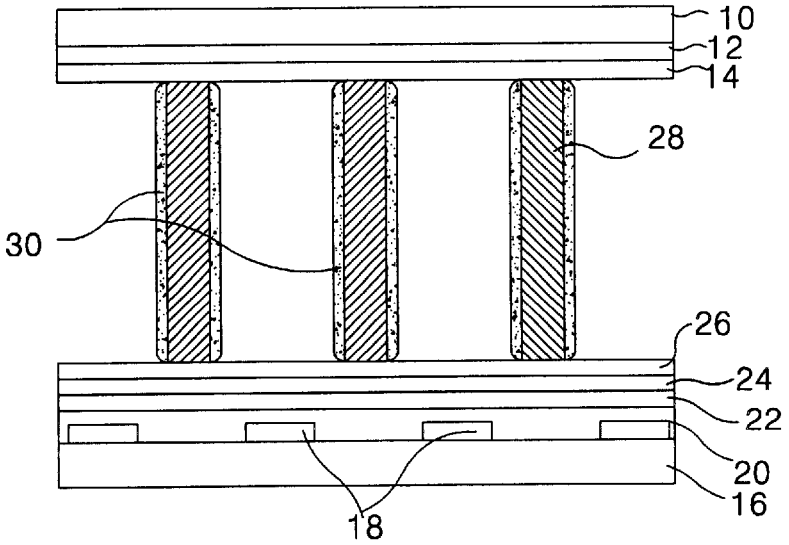
FIG. 2 RELATED ART
FIG. 2 is a sectional view of the radio frequency PDP shown in FIG. 1.
Figure 3:
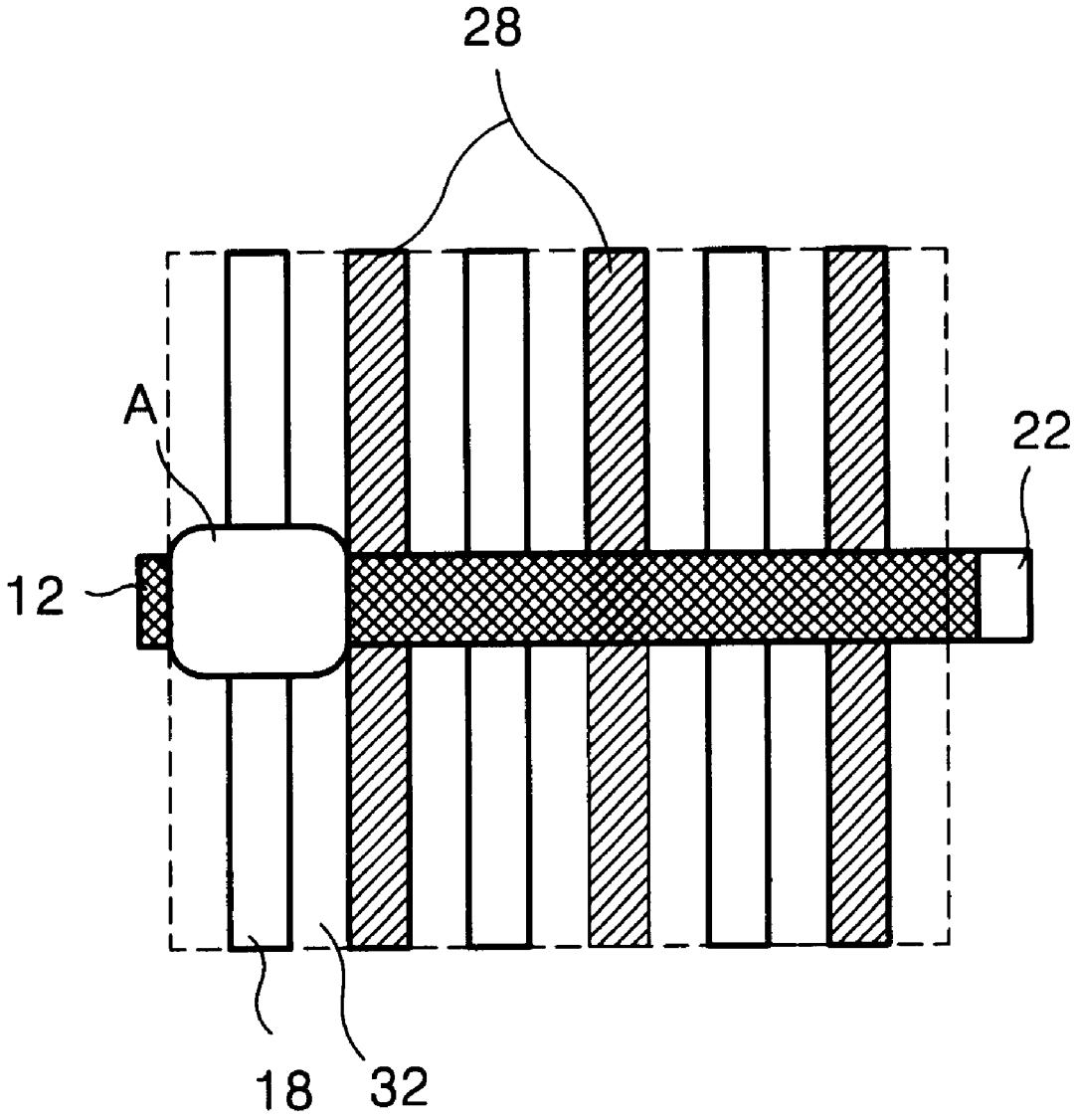
FIG. 3 RELATED ART
FIG. 3 illustrates a luminous area during a radio frequency discharge of the radio frequency PDP shown in FIG. 1.
Figure 4:
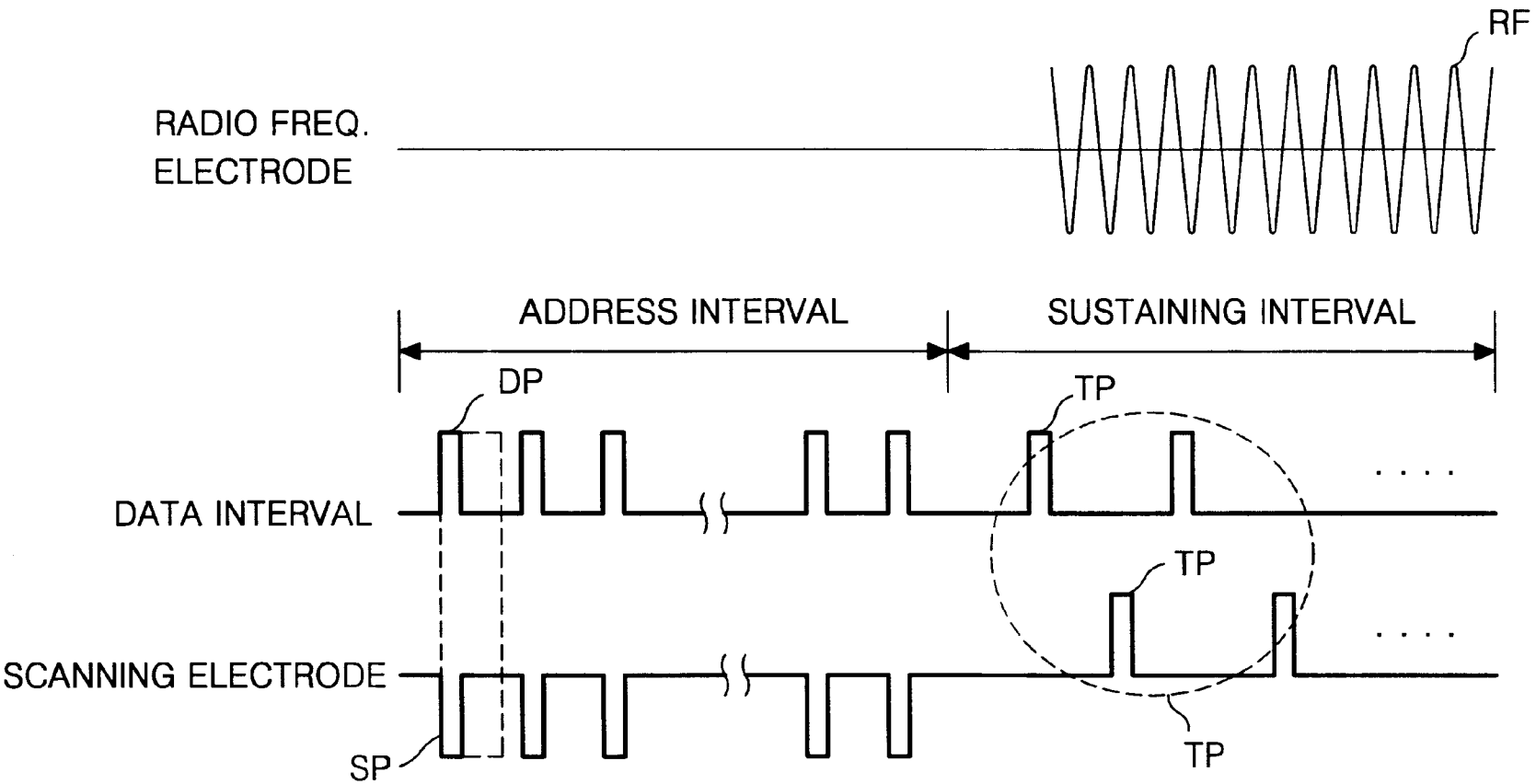
FIG. 4 RELATED ART
FIG. 4 is waveform diagrams of driving signals for the radio frequency. PDP shown in FIG. 1.
Figure 5:
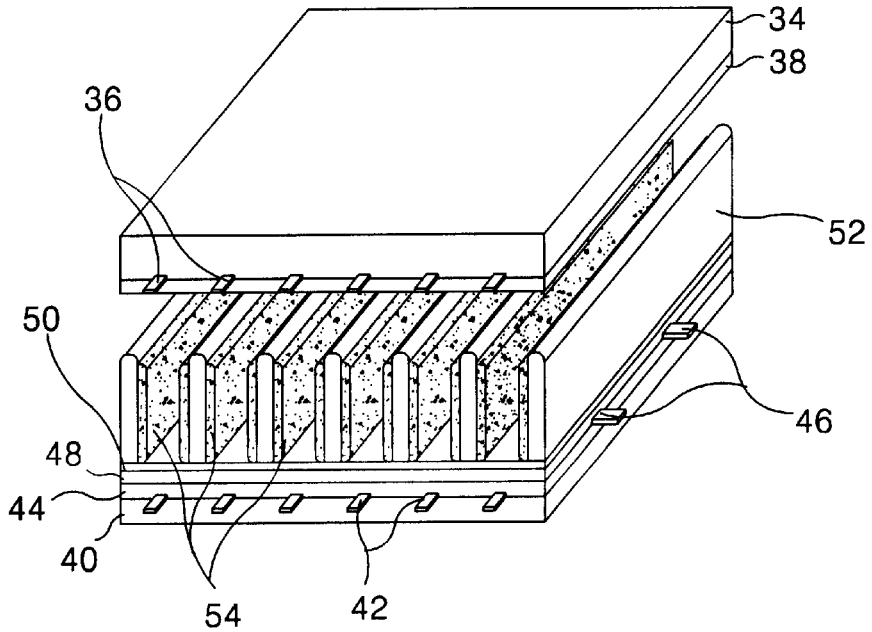
FIG. 5 is a perspective view showing the structure of a radio frequency PDP according to an embodiment of the present invention.
Figure 6:
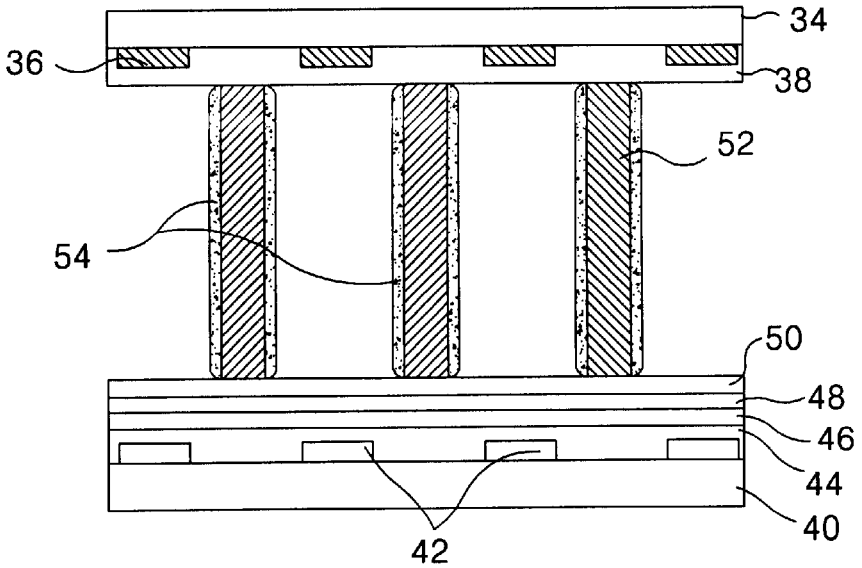
FIG. 6 is a sectional view of the radio frequency PDP shown in FIG. 5.

Referring to FIG. 5 and FIG. 6, there is shown a radio frequency PDP according to an embodiment of the present invention. The radio frequency PDP includes data electrodes 42 and scanning electrodes 46 provided on a lower substrate 40 in such a manner to be crossed with each other, and radio frequency electrodes 36 provided on an upper substrate 34 in such a manner to be crossed with the scanning electrodes. The upper substrate 34 is spaced, in parallel, from the lower substrate 40 by barrier ribs 52. The radio frequency electrode 36 supplies a radio frequency signal. The radio frequency electrode 36 is made from a transparent electrode material to improve an aperture ratio of the discharge cell, and further comprises a bus electrode to prevent a conductivity reduction caused by the transparent electrode material. On the upper substrate 36 provided with the radio frequency electrodes 36 are formed a first dielectric layer 38. The data electrodes 42 are provided on the lower substrate 40 in the same direction as the radio frequency electrodes 38. The scanning electrodes 46 are provided in a direction crossing the radio frequency electrode 38. Between the data electrodes 42 and the scanning electrodes 46 is formed a second dielectric layer 44 for insulation. On the second dielectric layer 44 provided with the scanning electrodes 46, a third dielectric layer 48 for electric charge accumulation and a protective film 50 are sequentially disposed. Barrier ribs 52 are formed on the upper part of the protective film 50, and a fluorescent material 54 is coated on the surfaces of the barrier ribs 52. The barrier ribs 52 are formed at a high level because a distance between the radio frequency electrode 36 and the scanning electrode 46 must be sufficiently assured for the sake of a smooth radio frequency discharge. In this case, the barrier rib 52 may be formed into a lattice shape so as to prevent a cross talk between the discharge cells. The discharge space is filled with a discharge gas.

Figure 7:
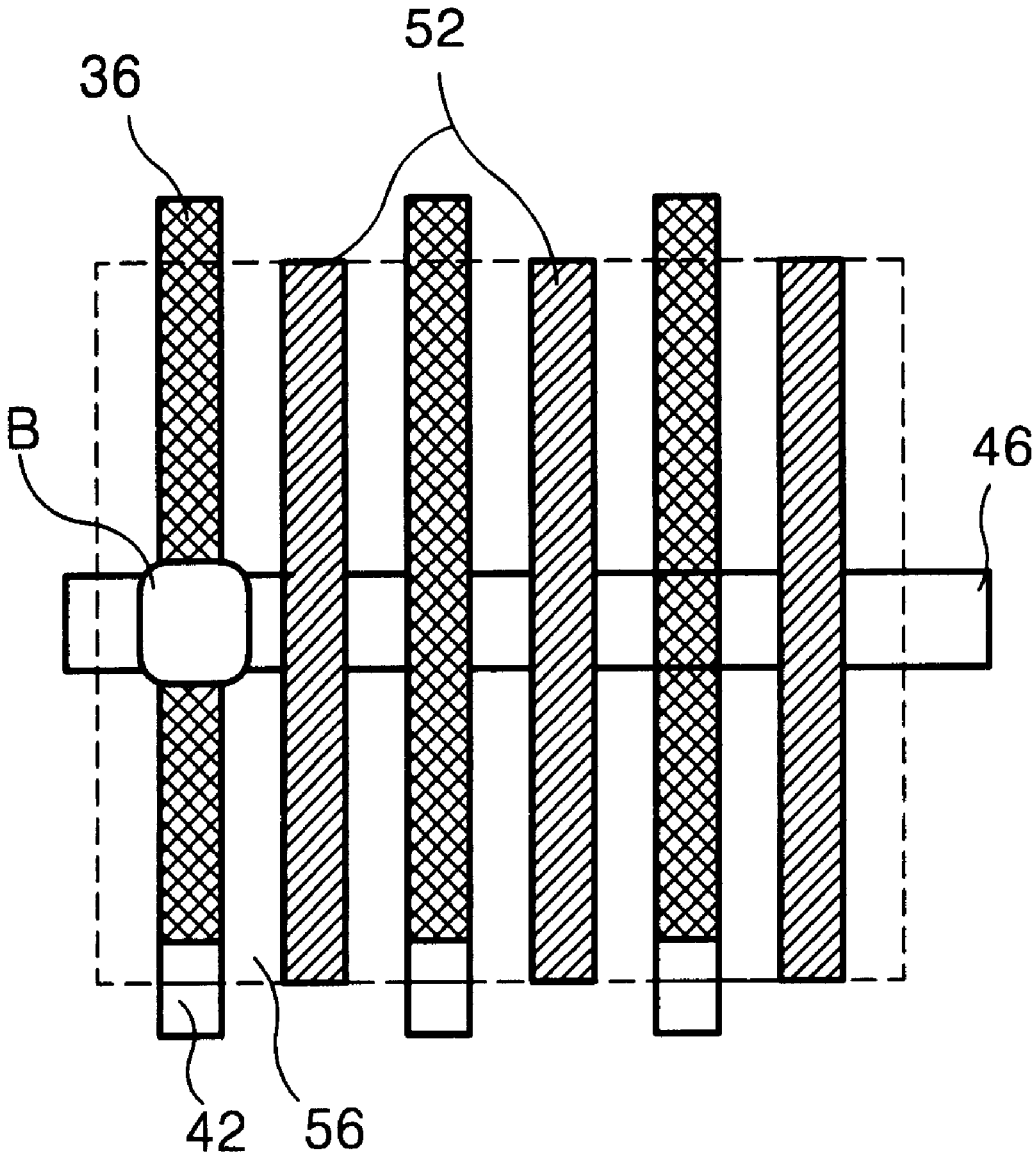
FIG. 7 illustrates a luminous area during a radio frequency discharge of the radio frequency PDP shown in FIG. 5.

In the radio frequency PDP having the structure as described above, as shown in FIG. 7, discharge cells 56 are provided at each intersection among the radio frequency electrodes 36, the scanning electrodes 46 and the data electrodes 42. The radio frequency electrodes 36 and the scanning electrodes 46 is arranged to be crossed with each other, and the data electrodes 42 are arranged in parallel to the radio frequency electrodes 36. In a certain discharge cell 56, an address discharge is generated between the data electrode 42 and the scanning electrode 46, and a radio frequency discharge is generated between the radio frequency electrode 36 and the scanning electrode 46. A luminous area (B) proportional to an area of the opposite electrode during the radio frequency discharge is limited to a perpendicular area between the radio frequency electrode 36 and the scanning electrode 46.

As described above, in the radio frequency PDP according to an embodiment of the present invention, the luminous area (B) is reduced, thereby decreasing a radio frequency discharge power as well as improving the luminescence efficiency in accordance with a reduction in discharge current. Also, the luminous area (B) is limited to prevent diffusion into the barrier ribs 52, so that a loss of a spurious energy caused by electrons absorbed into the barrier ribs 52 can be prevented to reduce a discharge power.

Figure 8:
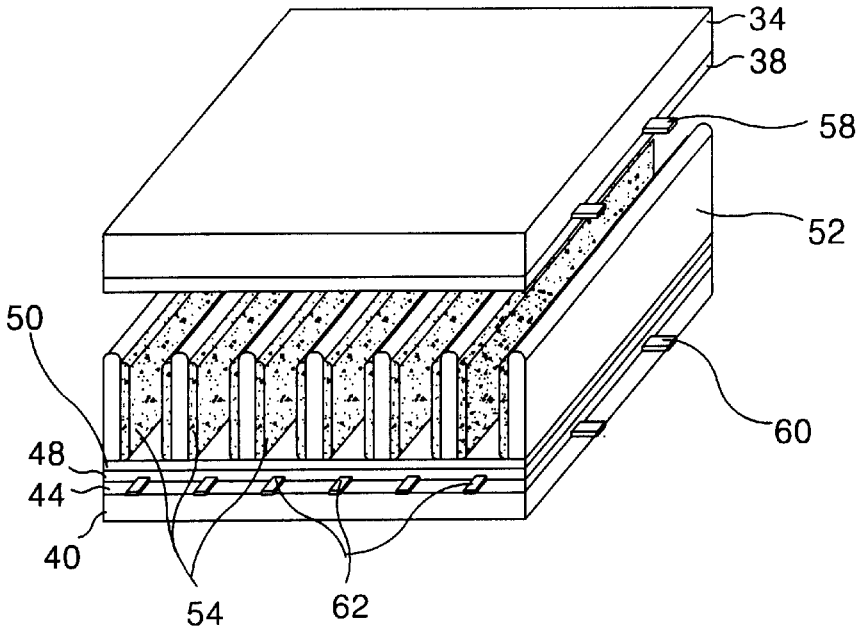
FIG. 8 is a perspective view showing the structure of a radio frequency PDP according to another embodiment of the present invention.
Figure 9:
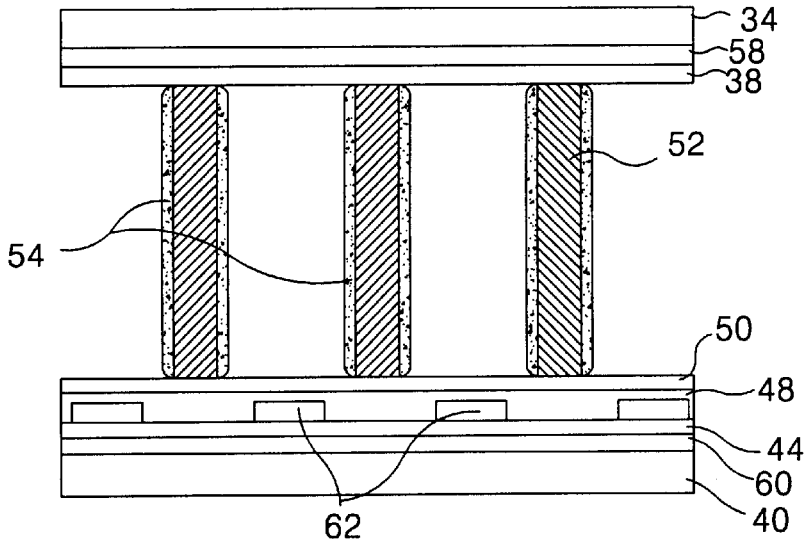
FIG. 9 is a sectional view of the radio frequency PDP shown in FIG. 8.
Figure 10:
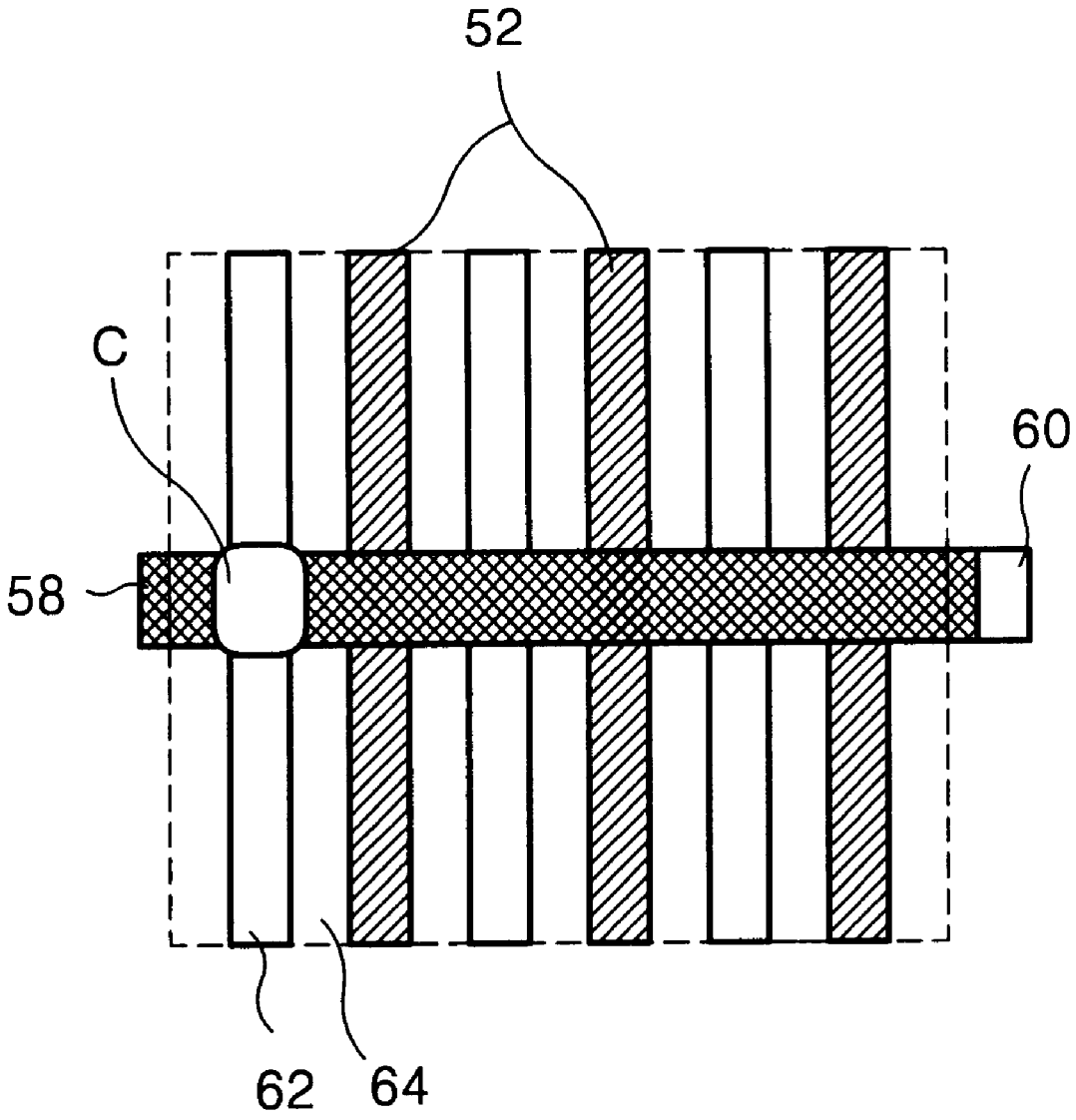
FIG. 10 illustrates a luminous area during a radio frequency discharge of the radio frequency PDP shown in FIG. 8.

Referring to FIG. 8 and FIG. 9, there is shown a radio frequency PDP according to another embodiment of the present invention. In the radio frequency PDP, radio frequency electrodes 58 is arranged to be parallel to scanning electrodes 60 and to be crossed with data electrodes 62 like the conventional radio frequency PDP. The data electrodes 62 having the structure crossing the radio frequency electrodes 58 are provided on the upper parts of the scanning electrodes 60 to be used for a radio frequency discharge. In other words, an address discharge is generated between the data electrode 62 and the scanning electrode 60, and a radio frequency discharge is generated between the radio frequency electrode 58 and the data electrode 62. When a radio frequency discharge is generated at a certain discharge cell 64, as shown in FIG. 10, a luminous area (C) proportional to an area of the opposite electrode during the radio frequency discharge is limited to a perpendicular area between the radio frequency electrode 58 and the data electrode 62.

As described above, in the radio frequency PDP according to an embodiment of the present invention, the luminous area (C) is reduced, thereby decreasing a radio frequency discharge power as well as improving the luminescence efficiency in accordance with a reduction in a discharge current. Also, the luminous area (C) is limited to prevent diffusion into the barrier ribs 52, so that a loss of a spurious energy caused by electrons absorbed into the barrier ribs 52 can be prevented to reduce a discharge power.

In addition, the radio frequency PDP according to the present invention does not require to consider the above-mentioned energy loss problem in fabricating the discharge cell with a fine structure owing to a limitation of the luminous areas B and C during the radio frequency discharge, so that it can implement a high resolution picture without a unnecessary increase in a discharge power.

Figure 11:
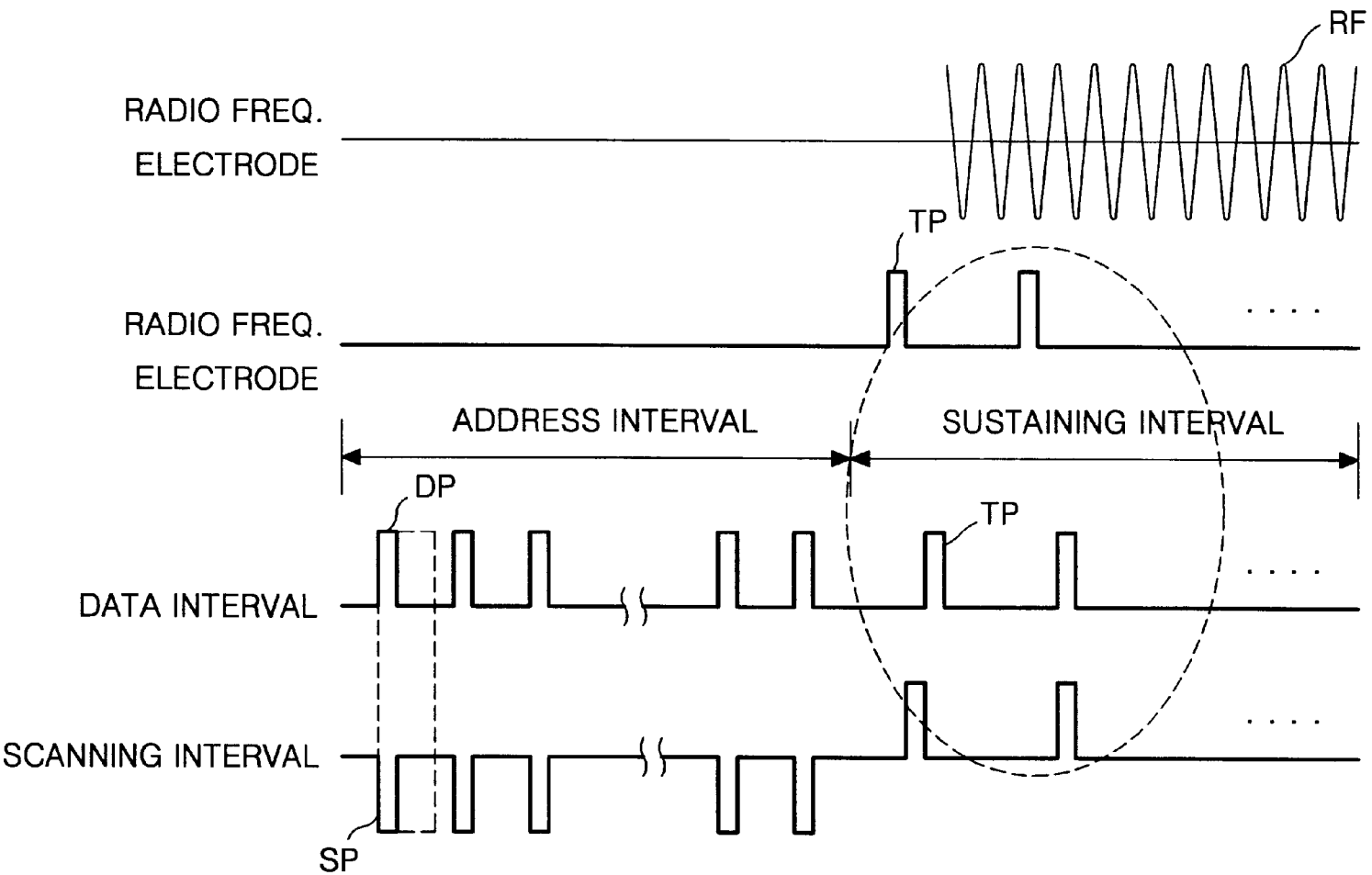
FIG. 11 is waveform diagrams of driving signals for explaining a method of driving a radio frequency PDP according to an embodiment of the present invention.

FIG. 11 illustrates driving waveforms for explaining a method of driving a radio frequency PDP according to an embodiment of the present invention. The driving waveforms are applicable to all of the three-electrode radio frequency PDP, but they will be described with reference to the radio frequency PDP shown in FIG. 5 for the convenience sake of explanation. In the address interval, a scanning pulse SP is line-sequentially applied to the scanning electrodes 46. At the same time, the data electrodes 42 are synchronized with the scanning pulse SP to apply a data pulse DP for each scanning line in accordance with a video data. Accordingly, an address discharge is generated by a voltage difference between the data electrodes 42 and the scanning electrodes 46 at the discharge cells to which the data pulse DP has been applied. Most charged particles produced by the address discharge are accumulated into a shape of wall charge. At the lapse of the address interval, a radio frequency signal RF for the radio frequency discharge is applied to the radio frequency electrodes 36 and, at the same time, a triggering pulse TP is alternately applied to the radio frequency electrodes 36 and the scanning electrode 46 and the data electrodes 42 opposed thereto. In this case, the triggering pulse TP applied to the radio frequency electrodes 36 may be supplied by further comprising a waveform generator for generating a triggering pulse. A triggering discharge is generated by a triggering pulse applied to the radio frequency electrodes 36, the scanning electrodes 46 and the data electrodes 42 at the discharge cells in which a wall charge is formed by the address discharge. More charged particles are activated by this triggering discharge, and the charged particles are drawn into the radio frequency signal RF to initiate a radio frequency discharge. In this case, the triggering discharge uniforms a wall charge amount having a nonuniform distribution at each discharge cell due to a discharge time difference in the address discharge to generate a uniform radio frequency discharge. Such a triggering discharge is generated only by the triggering pulse TP applied to the scanning electrodes 46 and the data electrodes 42 like the prior art, but may be generated by the triggering pulse TP applied to the radio frequency electrodes 36, too. Accordingly, the charged particles caused by the triggering discharge are produced at an area near to the radio frequency electrodes 36 unlike the prior art. Electrons in the charged particles produced at the area close to the radio frequency electrodes 36 are more easily drawn to a smaller voltage level of radio frequency signal to make an oscillating motion within the discharge space. Accordingly, a voltage level of the radio frequency signal for drawing electrons is decreased, so that a radio frequency discharge power can be reduced. Also, a lot of charged particles are produced at the area close to the radio frequency electrodes 36, thereby increasing an amount of electrons that are drawn into the radio frequency signal to generate a discharge while doing an oscillating motion. Accordingly, more lots of vacuum lays are generated to radiate the fluorescent material 54, so that the luminescence efficiency can be improved.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a radio frequency plasma display panel, comprising:

(A) applying a pulse to each of a scanning electrode and a data electrode crossed with each other to cause an alternating current discharge, thereby selecting cells to be displayed;

(B) applying a radio frequency signal to a radio frequency electrode and applying a reference voltage of the radio frequency signal to any one of the scanning electrode and the data electrode, thereby generating a radio frequency discharge at the cells selected at said step (A); and (C) supplying a triggering pulse to the radio frequency electrode and the electrode to which the reference voltage is applied at an initiation time of the radio frequency discharge to generate a triggering discharge for initiating the radio frequency discharge.

2. The method as claimed in claim 1, wherein the triggering pulse in an alternating current pulse and said alternating current pulse is alternately applied to the radio frequency electrode and the electrode to which the reference voltage is applied during a desired time interval.

3. The method as claimed in claim 1, wherein a triggering pulse comprising an alternating current pulse for generating the triggering discharge is applied to the remaining electrode except for the electrode to which the reference voltage is applied in the scanning electrode and the data electrode.

4. A plasma display panel employing a radio frequency discharge, comprising:

a data electrode and a scanning electrode arranged perpendicularly to each other to generate an address discharge; and a radio frequency electrode arranged perpendicularly to the scanning electrode to generate the radio frequency discharge by applying a radio frequency signal.

5. The plasma display panel as claimed in claim 4, wherein the scanning electrode is supplied with a scanning signal during the address discharge and a ground voltage of the radio frequency signal during the radio frequency discharge.

6. The plasma display panel as claimed in claim 4, wherein the radio frequency electrode is formed in a first substrate, and the data electrode and the scanning electrode are formed in a second substrate.

* * * * *